United States Patent [19]

Josephson

[11] Patent Number: 4,744,290

[45] Date of Patent: May 17, 1988

[54] PIVOTED DAMPER BLADE AND PIN THEREFOR

[75] Inventor: Louis Josephson, Yonkers, N.Y.

[73] Assignee: American Hardware & Paint Co., Inc., Irvington, N.J.

[21] Appl. No.: 80,800

[22] Filed: Aug. 3, 1987

[51] Int. Cl.[4] ..... F24F 13/14

[52] U.S. Cl. ..... 98/121.2; 16/243; 49/403; 98/110; 126/291; 251/308; 403/104; 403/388

[58] Field of Search ..... 16/224, 243, 270, 254, 16/249; 49/403; 98/107, 110, 121.2; 126/285 R, 288, 289, 291; 251/304, 308; 403/104, 388; 292/149, 345; 411/187, 188, 369, 542

[56] References Cited

U.S. PATENT DOCUMENTS

| | | | |
|---|---|---|---|
| 493,363 | 3/1893 | Lang | 126/292 |
| 2,146,142 | 2/1939 | Heasley | 126/285 R |
| 2,183,292 | 12/1939 | Kerentoff | 126/292 |
| 3,156,446 | 11/1964 | Chaloka | 98/110 X |
| 3,260,018 | 7/1966 | Schuh | 292/345 X |
| 3,487,768 | 1/1970 | Watson | 98/110 X |
| 3,718,081 | 2/1973 | Root | 98/121.2 X |
| 3,779,512 | 12/1973 | Scaramucci | 251/308 |
| 4,355,567 | 10/1982 | Josephson | 98/110 X |
| 4,682,758 | 7/1987 | Scobie et al. | 251/308 X |

FOREIGN PATENT DOCUMENTS 656748 2/1938 Fed. Rep. of Germany ..... 251/308

*Primary Examiner*—Harold Joyce

*Attorney, Agent, or Firm*—Dressler, Goldsmith, Shore, Sutker & Milnamow, Ltd.

[57] ABSTRACT

A pivoted blade which has a centrally positioned V-shaped pin-receiving depression combined with a slidable mounting pin which is releasably secured within the depression in the blade. This pin comprises an elongated element which is circular in cross-section at one end thereof, and its other end is flattened at one side and of V-shape on the other side. The other end of the pin has a centrally positioned hole extending therethrough with this hole being centrally disposed with respect to the flattened side and extending through the apex of the V-shaped side. This centrally positioned hole is longer than it is wide with the longer cross-section extending longitudinally of the pin. The mounting pin is mounted at a side margin of the blade with the V-shaped portion of the pin fitting into the V-shaped depression in the blade and with the end of circular cross-section extending beyond the side margin of the blade. A bolt extends through a hole in the apex of the V-shaped depression in the blade and through the hole in the pin, and a nut is associated with the free end of the bolt to lock the pin to the blade.

5 Claims, 1 Drawing Sheet

PIVOTED DAMPER BLADE AND PIN THEREFOR

TECHNICAL FIELD

This invention relates to pivoted damper blades, and more particularly to the combination of a damper blade having a central portion bent to form a V-shaped depression with a longitudinally slidable mounting pin which is secured within the depression. The invention includes the pins having two ends of different cross-section which are used in the combination and which avoid distortion of the damper blade and/or the pin when the two are secured together.

BACKGROUND ART

Pivoted blade dampers are well known and in common use, but for many years it was not possible to employ a construction which was easy to build, reliable to operate, and easy to service. These needs to a considerable extent were satisfied by the slidable mounting pin construction disclosed in my prior U.S. Pat. No. 4,355,567 issued Oct. 26, 1982.

The slidable mounting pins and the combination of these pins with a pivoted blade disclosed in said patent are now in widespread use in commerce. However, some difficulties have been encountered when the pin-receiving depression in the central portion of the pivoted blade is of V-shape because when the nut and bolt used to secure the pin within the pin-receiving depression is excessively tightened, the pivoted blade can be deformed and/or the pin can be bent which leads to misalignment of the blades in the damper. As should be evident, the misaligned blades will not seat properly, so the damper will leak or jam, which wastes energy and can damage equipment.

Damper blades having a centrally positioned pin-receiving depression of V-shape are particularly easy to provide, being formable by merely bending the blade using the commonly available brake. This is why damper blades of this configuration are most commonly used in commerce. Nonetheless, the art has not been able to overcome the distortion of the damper blades having a V-shaped pin-receiving depression, instead electing to position the cylindrical pin disclosed in my prior patent and to tighten the nut and bolt used to secure it as carefully as possible. Nonetheless, some workmen are better than others, and it is desired to avoid the distortion which sometimes resulted.

In an effort to ease the distortion problem, the art has employed blades of special construction, but this introduces undesired expense which is avoided by this invention.

DISCLOSURE OF INVENTION

In accordance with this invention, a pivoted blade having a centrally positioned V-shaped pin-receiving depression is combined with a longitudinally slidable pin which comprises an elongated element which is circular in cross-section at one end thereof and which has its other end flattened on one side and of V-shape on the other side. This other end of the pin has a centrally positioned hole extending therethrough with this hole being centrally disposed with respect to the flattened side and extending through the apex of the V-shaped side. The hole has a cross-section which is longer than it is wide with the longer cross-section extending longitudinally of the pin.

The mounting pin is mounted at a side margin of a blade having a V-shaped pin-receiving depression in its central portion with the V-shaped portion of the pin fitting into the V-shaped depression in the blade and with the end of circular cross-section extending beyond the side margin of the blade. A bolt extends through a hole in the apex of the V-shaped depression in the blade and through the hole in the pin, and a nut is associated with the free end of the bolt to lock the pin to the blade. Excessive tightening of the nut on the blade in this construction does not distort the blade or the pin.

In preferred practice, the width of the hole is smaller than the width of the flattened side to provide a bearing shoulder, and either the head of the bolt or the nut bears against this shoulder. As will be obvious, it does not matter which way the bolt extends through the hole.

By using an elongated pin having a different cross-section at its opposite ends with the non-circular hole positioned on the end of the pin which is non-circular in cross-section, both ends are able to serve different functions. The end of circular cross-section provides the desired pivotal mounting to the frame of the damper, and the V-shaped portion at one side of the other end of the pin fits into the V-shaped depression of the blade. In this way when the nut and bolt are tightened to secure the pin to the blade, these mating surfaces are forced together with an automatic centering action, and distortion of the blade is effectively eliminated, even when the nut is tightened excessively.

Moreover, there is a greater contact surface between the blade depression and the mounting pin, so even when the nut is only lightly tightened, longitudinal movement of the pin within the blade depression is avoided. In this way the longitudinal slidability of the patented construction is retained with all its advantages, but longitudinal immobility is enhanced when it is not desired.

The invention will be more fully understood from the accompanying drawings in which.

Figure 1:
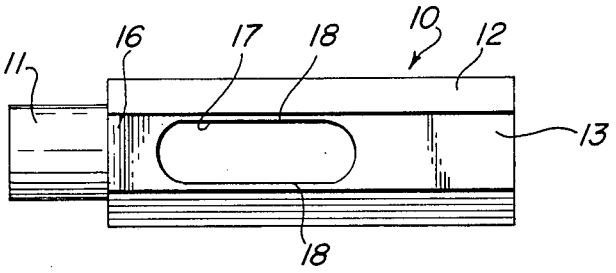
FIG. 1 is a top plan view of a mounting pin constructed in accordance with this invention.
Figure 2:
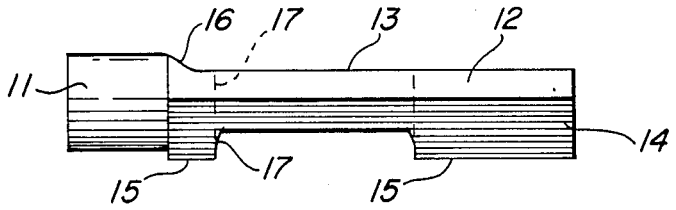
FIG. 2 is a side elevation of the mounting pin shown in FIG. 1.
Figure 3:
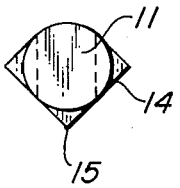
FIG. 3 is an end view of the mounting pin from its cylindrically-shaped end.
Figure 4:
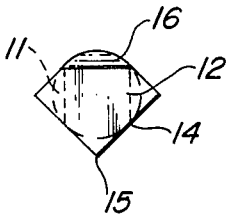
FIG. 4 is an end view of the mounting pin from its other end.
Figure 5:
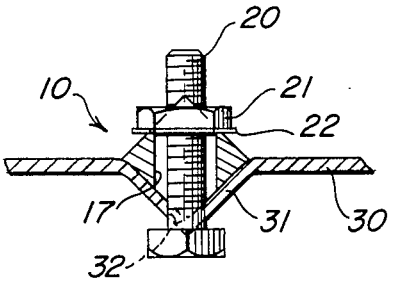
Figure 6:
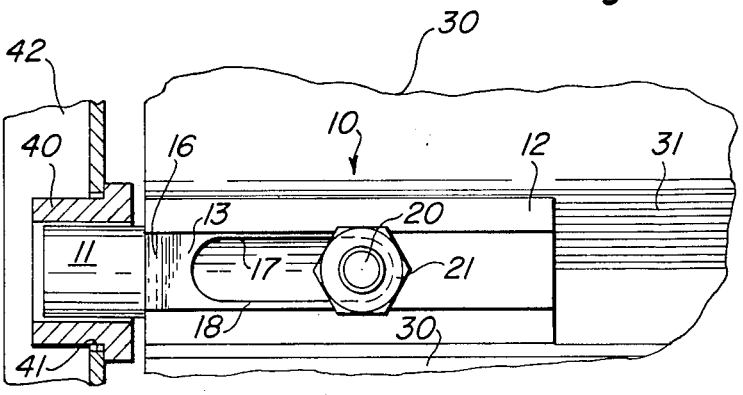

FIG. 5 is a partial cross-section showing the mounting pin held within the V-shaped central portion of a damper blade by means of a bolt which extends through a hole in the apex of the V-shaped portion of the blade and the similarly disposed hole in the mounting pin and a nut which is tightened upon the bolt; and FIG. 6 is a partial elevation showing the blade-mounting pin combination being pivotally secured within a portion of a damper frame.

Referring more particularly to the drawings, it will be seen that the elongated mounting pin 10 is formed with one end 11 of circular cross-section which has a length which is much shorter than the length of the other end 12 which is of non-circular cross-section. While this shortened portion of circular cross-section is preferred in normal practice, when this circular portion is to be used to drive the blades, then it can be lengthened to accomodate that purpose.

The end of non-circular cross-section has a flat side 13 and a V-shaped side 14 having an apex 15. Between the ends 11 and 12, the change in cross-section is abrupt, except near the flat side 13 where the surfaces are connected by a merge 16.

A hole 17 extends through the end 12 intermediate its length, being centered on the flat side 13 and intersecting the apex 15. This hole 17 is longer than it is wide with its longer portion paralleling the axis of the pin. This allows the pin to slide longitudinally on the securing bolt 20 shown in FIGS. 5 and 6 to facilitate installing the blade in a damper being constructed or retrofitted. Also, the flat side 13 is wider than the hole 17, providing a shoulder 18 for the bolt or nut to bear against.

As can be seen in FIG. 5, the pin 10 is combined with a damper blade 30 having a V-shaped central depression 31 using a bolt 20 which extends through a hole 32 in the apex of the depression 31 and which also extends through the hole 17. The V-shaped side 15 of the pin 10 rests in the depression 31, and since these both have the same V-shape, when the nut 21 is tightened on the bolt 20, there is an automatic centering action, the pin has an extended surface bearing against the depression 31 to insure immobility, and one cannot distort either the pin or the blade by excessive tightening of the nut on the bolt. A lock washer 22 is usually employed, as shown, but is not essential.

The combination of damper blade and mounting pin shown in FIG. 5 is then used in FIG. 6 where it will be seen that the circular portion 11 of the pin extends beyond the side margin of blade 30, entering bushing 40 which is positioned with an opening 41 in a side portion 42 of a damper frame. As is shown in the figure, the pin 10 has been longitudinally shifted before the nut 21 is tightened to extend the circular portion 11 of the pin so that it is in position to enter bushing 40. If the nut 21 were loosened, the pin could be shifted to retract its end 11 to facilitate insertion or removal of the blade-mounting pin combination from the damper frame.

What is claimed is:

1. A pivoted blade having a centrally positioned V-shaped pin-receiving depression in combination with a longitudinally slidable mounting pin which is releasably secured within said depression, said pin comprises an elongated element which is circular in cross-section at one end thereof and having its other end flattened on one side and of V-shape on the other side, said other end of said pin having a centrally positioned hole extending therethrough with this hole being centrally disposed with respect to the flattened side and extending through the apex of the V-shaped side, said centrally positioned hole having a cross-section which is longer than it is wide with the longer cross-section extending longitudinally of the pin, said mounting pin being mounted at a side margin of a blade with the V-shaped portion of the pin fitting into the V-shaped depression in the blade and with the end of circular cross-section extending beyond the side margin of said blade, a bolt extending through a hole in the apex of the V-shaped depression in the blade and through the hole in the pin, and a nut associated with the free end of the bolt and locking the pin to the blade.

2. A combination as recited in claim 1 in which the width of said hole in the pin is smaller than the width of said flattened side to provide a shoulder surrounding said hole and either the head of said bolt or said nut bears against said shoulder.

3. A combination as recited in claim 1 in which the length of said end of circular cross-section is much shorter than the length of said other end.

4. A mounting pin comprises an elongated element which is circular in cross-section at one end thereof and having its other end flattened on one side and of V-shape on the other side, said other end of said pin having a centrally positioned hole extending therethrough with this hole being centrally disposed with respect to the flattened side and extending through the apex of the V-shaped side, said centrally positioned hole having a cross-section which is longer than it is wide with the longer cross-section extending longitudinally of the pin, and the width of said hole being smaller than the width of said flattened side to provide a shoulder surrounding said hole.

5. A mounting pin as recited in claim 4 in which the length of said end of circular cross-section is much shorter than the length of said other end.

* * * * *